US009082249B2

(12) United States Patent
Hancock et al.

(10) Patent No.: US 9,082,249 B2
(45) Date of Patent: Jul. 14, 2015

(54) SNAIL WHEEL

(71) Applicant: Flextronics AP, LLC, Broomfield, CO (US)

(72) Inventors: Stephen H. Hancock, Wake Forest, NC (US); Brandon M. Warzecho, Cary, NC (US)

(73) Assignee: Flextronics AP, LLC, Broomfield, CO (US)

( * ) Notice: Subject to any disclaimer, the term of this patent is extended or adjusted under 35 U.S.C. 154(b) by 71 days.

(21) Appl. No.: 13/833,879

(22) Filed: Mar. 15, 2013

(65) Prior Publication Data

US 2014/0239008 A1 Aug. 28, 2014

Related U.S. Application Data

(60) Provisional application No. 61/770,138, filed on Feb. 27, 2013.

(51) Int. Cl.
*G07F 11/24* (2006.01)
*G07F 11/00* (2006.01)

(52) U.S. Cl.
CPC ..... *G07F 11/005* (2013.01); *G07F 11/24* (2013.01)

(58) Field of Classification Search
CPC ..... G07F 11/24; G07F 11/34
USPC ..... 221/192, 194, 195, 196, 256, 277, 217, 221/273
See application file for complete search history.

(56) References Cited

U.S. PATENT DOCUMENTS

| | | | | |
|---|---|---|---|---|
| 1,004,427 | A * | 9/1911 | Hillyer | 221/236 |
| 2,711,241 | A * | 6/1955 | Abrahamsen | 193/38 |
| 3,338,471 | A * | 8/1967 | De Good | 221/129 |
| 4,316,648 | A * | 2/1982 | Lissack | 359/214.1 |
| 4,852,767 | A * | 8/1989 | Humphrey | 221/241 |
| 5,092,489 | A * | 3/1992 | Pastor et al. | 221/108 |
| 5,617,791 | A * | 4/1997 | Furbass | 101/420 |
| 6,851,563 | B1 * | 2/2005 | Lipari | 211/74 |
| 2002/0043509 | A1 * | 4/2002 | Lajeunesse et al. | 211/59.2 |
| 2011/0060693 | A1 * | 3/2011 | Consiglio et al. | 705/308 |

* cited by examiner

*Primary Examiner* — Patrick Mackey
(74) *Attorney, Agent, or Firm* — Volpe and Koenig, P.C.

(57) ABSTRACT

A method and apparatus for operating a snail wheel in a vending machine are disclosed. The method for operating the snail wheel includes accepting a 5 gallon water bottle into the snail wheel, lifting the 5 gallon water bottle up off a bottom shelf of the vending machine, rotating the snail wheel 90° from a starting point, stopping the snail wheel after rotating 90°, wherein at the 5 gallon water bottle rolls out of the snail wheel and onto a platform, and rotating the snail wheel 270° back to the starting point.

18 Claims, 6 Drawing Sheets

SNAIL WHEEL

CROSS REFERENCE TO RELATED APPLICATION

This application claims the benefit of U.S. Provisional Application No. 61/770,138 filed Feb. 27, 2013, the contents of which are hereby incorporated by reference herein.

FIELD OF INVENTION

This application is in the field of consumer products.

BACKGROUND

Typically, a vending machine retrieval area is located close to the ground. This permits the machine to be filled with as much product as possible, while still permitting the vended product to be gravity fed to the retrieval area.

A 5 gallon water bottle is an extremely heavy, (approximately 40 pounds), object for an average consumer to handle. If the vended product is a 5 gallon water bottle, when this retrieval area is located close to the ground, this may foster consumer injuries. Accordingly, it is beneficial for the 5 gallon water bottles to be retrieved at a position that is both comfortable for the consumer and helps to avoid consumer injuries.

In order to raise a 5 gallon water bottle off the ground, a typical vending machine takes the 5 gallon water bottle from a lower portion of the machine and places it on a fork lift mechanism inside the machine. The fork lift mechanism raises the 5 gallon water bottle to an easily accessible height for retrieval by a consumer.

The use of the fork lift mechanism inside the vending machine is a costly solution. A cheaper solution to retrieve the 5 gallon water bottle at an easily accessible height is needed.

SUMMARY

A method and apparatus for operating a snail wheel in a vending machine are disclosed. The method for operating the snail wheel includes accepting a 5 gallon water bottle into the snail wheel, lifting the 5 gallon water bottle up off a bottom shelf of the vending machine, rotating the snail wheel from a starting point, stopping the snail wheel after a predetermined amount of rotation, wherein at the 5 gallon water bottle rolls out of the snail wheel and onto a platform, and rotating the snail wheel back to its starting position.

BRIEF DESCRIPTION OF THE DRAWINGS

A more detailed understanding may be had from the following description, given by way of example in conjunction with the accompanying drawings wherein.

DETAILED DESCRIPTION

Figure 1A:
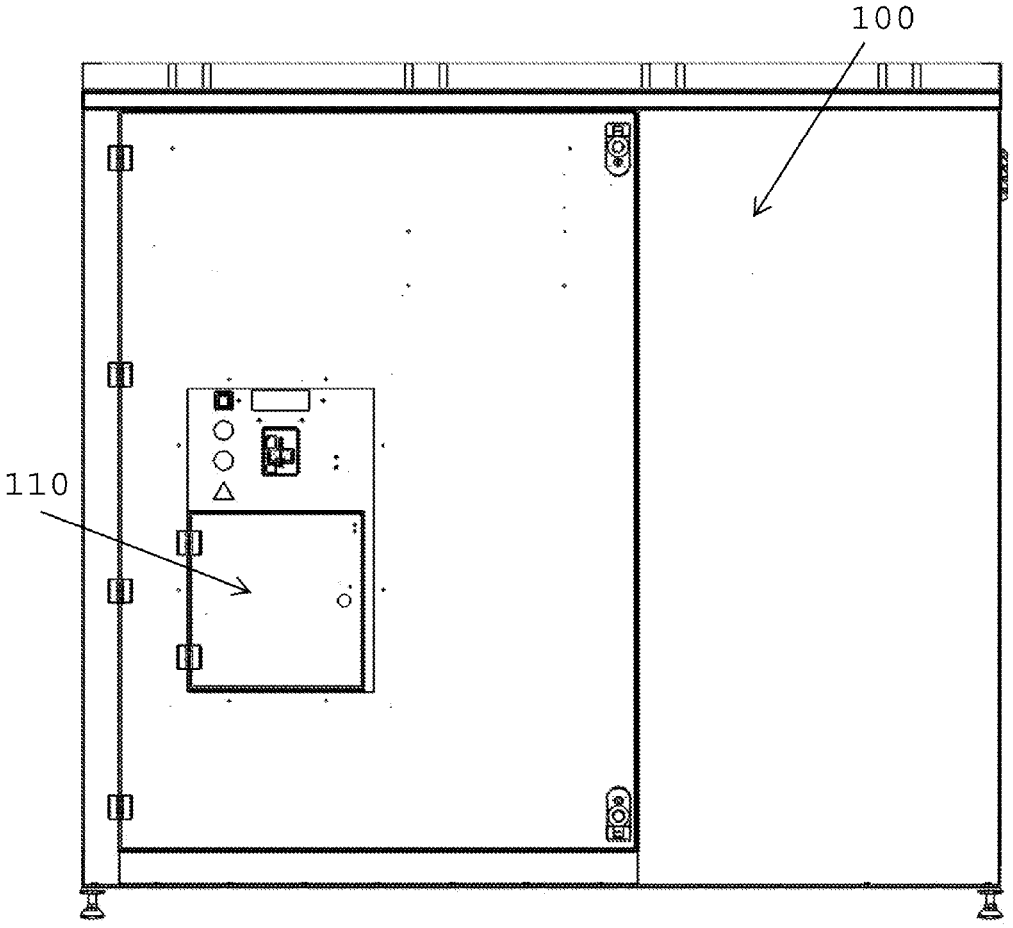
FIG. 1A is an example of a 5 gallon water bottle vending machine.

This invention is described in the following description with reference to the Figures, in which like reference numbers represent the same or similar elements. While this invention is described in terms of modes for achieving this invention's objectives, it will be appreciated by those skilled in the art that variations may be accomplished in view of these teachings without deviating from the spirit or scope of the present invention. The embodiments and variations of the invention described herein, and/or shown in the drawings, are presented by way of example only and are not limiting as to the scope of the invention.

Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

FIG. 1A is an example of a 5 gallon water bottle vending machine. As illustrated in FIG. 1, a vending machine 100 holds and stores a number of 5 gallon water bottles. The vending machine 100 includes a vend door 110. The vend door 110 is raised off the ground to allow for easy access and retrieval of the 5 gallon water bottles by a consumer.

Figure 1B:
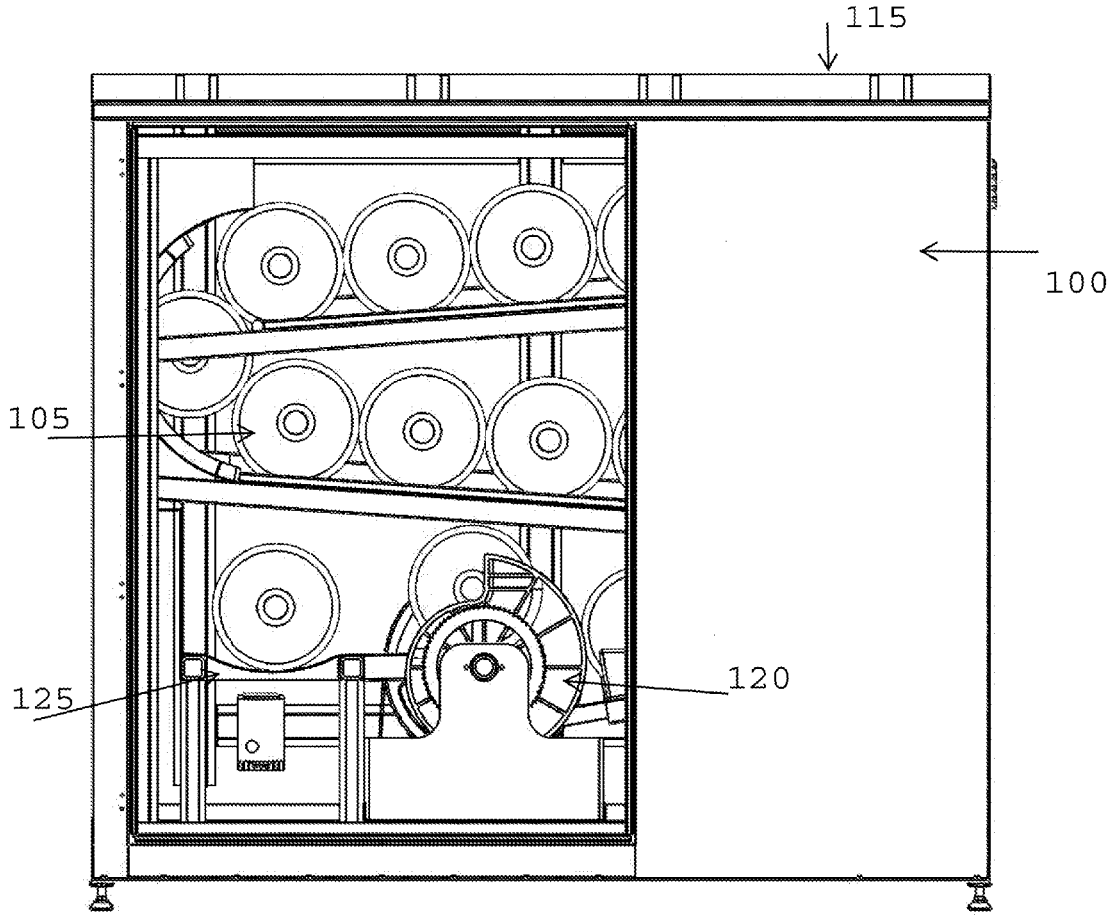
FIG. 1B is an example of the 5 gallon water bottle vending machine with a front panel removed.

FIG. 1B is an example of the 5 gallon water bottle vending machine with a front panel removed. As illustrated in FIG. 1B, the vending machine 100 holds and stores a plurality of 5 gallon water bottles 105. The 5 gallon water bottles 105 may typically be fed into the vending machine 100 through an opening in the top 115. The 5 gallon water bottles 105 move down the vending machine 100 shelves in a snake pattern. The 5 gallon water bottles 105 are obtained from the vending machine 100 at the platform 125, inside the vend door 110 (shown in FIG. 1B). A snail wheel 120 lifts the 5 gallon water bottle 105 off of the vending machine 100 shelf and onto the platform 125 for the consumer to retrieve.

Figure 2:
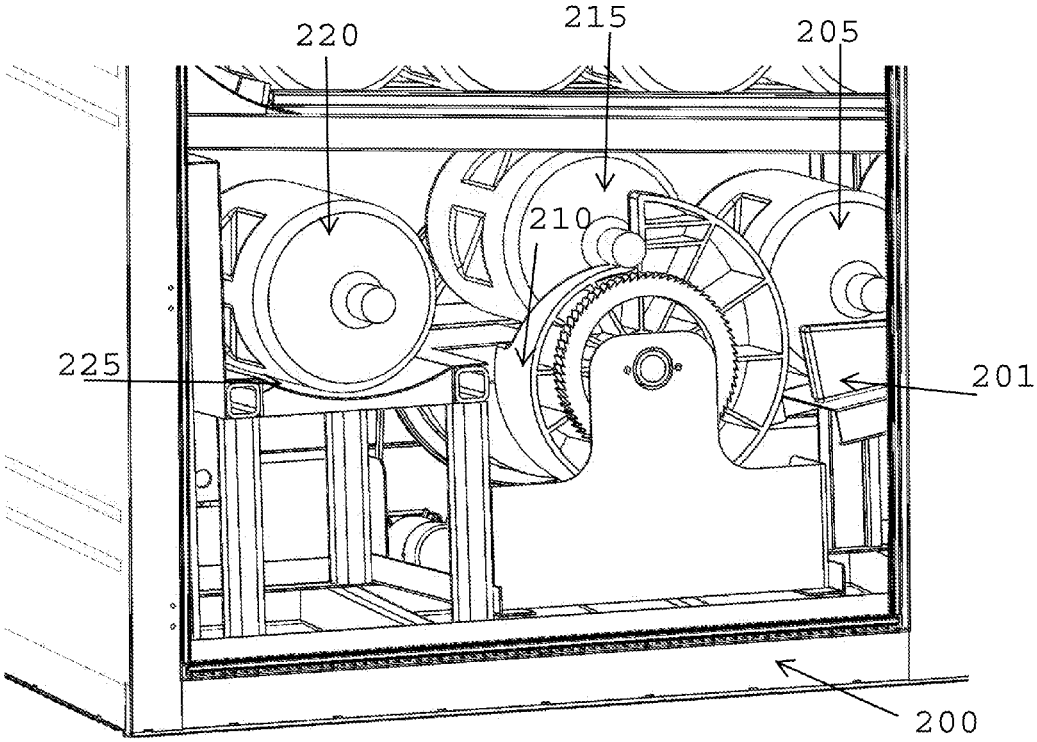
FIG. 2 is an example of snail wheel in a vending machine.

FIG. 2 is an example of a snail wheel in a vending machine. As illustrated in FIG. 2, the snail wheel 210, (which has a cam-like profile), may be used for 5 gallon water bottles 205. FIG. 2 illustrates the bottom shelf 201 of the vending machine 200 where the bottles are ultimately dispensed to a customer. The 5 gallon water bottle 205 rolls to a stop prior to entering the snail wheel 210. The snail wheel 210 includes a lip 213, which allows the neck of the 5 gallon water bottle 205 to rest upon. The lip 213 remains at a resting point that is level with the bottom shelf 201. The 5 gallon water bottle 205 stays in place with a license plate stopper (not shown).

When a customer wants a 5 gallon water bottle, for example 5 gallon water bottle 205, the license plate stopper depresses and the 5 gallon water bottle 205 rolls onto the snail wheel 210. The snail wheel 210 rotates 90° counter-clockwise, lifting the 5 gallon water bottle, for example 215, off the bottom shelf 201. Once the snail wheel 210 rotates 90°, it stops to allow the 5 gallon water bottle 215 to roll down the remainder of the snail wheel 210 and onto a slightly raised platform 225. The platform 225 is behind the vend door 110 shown in FIG. 1. The customer may then retrieve the 5 gallon water bottle, for example 220, from the platform 225. Although in the example shown is FIG. 2 the 5 gallon water bottle 220 is lifted only a small amount, it should be understood by those of skill in the art that this is an example only.

Greater or lesser amounts of height may be achieved by changing the configuration and dimensions of the snail wheel 210.

Figure 3:
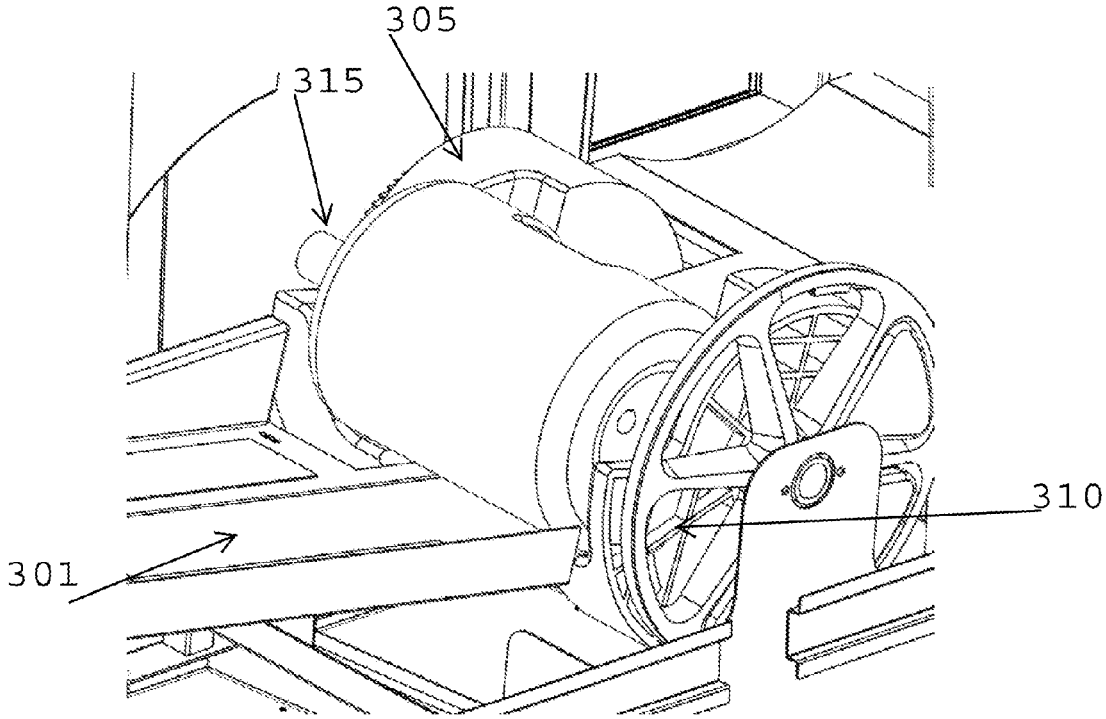
FIG. 3 is an example of a 5 gallon water bottle entering a snail wheel in a vending machine.

FIG. 3 is an example of a 5 gallon water bottle entering a snail wheel in a vending machine. In FIG. 3, a 5 gallon water bottle 305 rolls onto the snail wheel 310 after the license plate stopper 320 is depressed. The 5 gallon water bottle 305 has a neck 315 that fits into a flange of the snail wheel 310. When the 5 gallon water bottle 305 rolls on the snail wheel 310, it remains on the bottom shelf 301 of the vending machine until it is lifted up and over the snail wheel 310.

Figure 4:
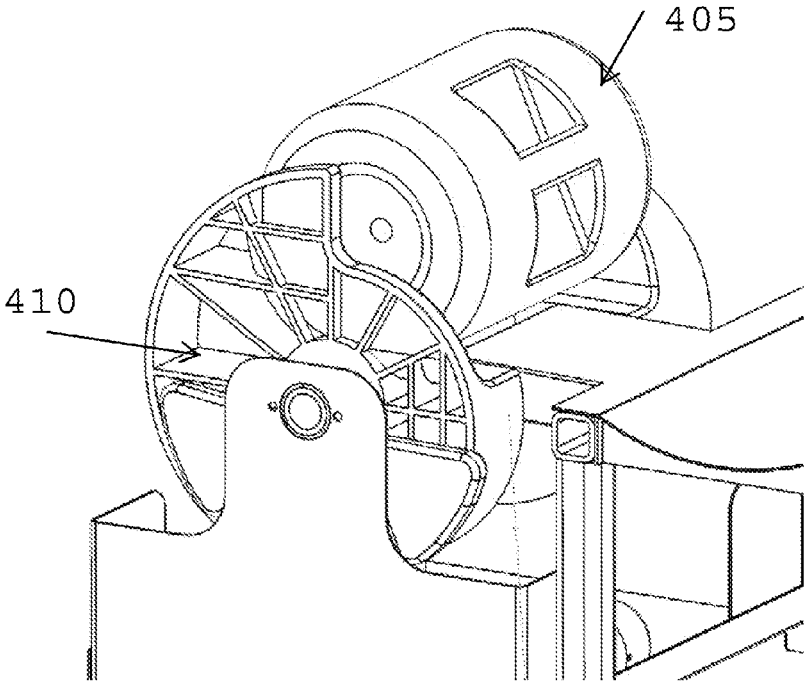
FIG. 4 is an example of a 5 gallon water bottle being lifted off a vending machine shelf for distribution to a customer.

FIG. 4 is an example of a 5 gallon water bottle being lifted off a vending machine shelf for distribution to a customer. As illustrated in FIG. 4, the snail wheel 410 rotates 90° counter-clockwise, lifting the 5 gallon water bottle 405 off the bottom shelf of the vending machine. Once the snail wheel 410 rotates 90° it stops thereby allowing the 5 gallon water bottle 405 to roll down the remainder of the snail wheel 410 and onto a platform for customer retrieval.

It should be understood that although the snail wheel 510 is generally shown as circular in nature, it may be elongated, such that it can lift the 5 gallon water bottle 505 to greater heights for dispensing, depending upon the height requirements. In this case, the flanges 515 will hold the 5 gallon water bottle 505 at a greater axial distance from the central shaft.

Figure 5:
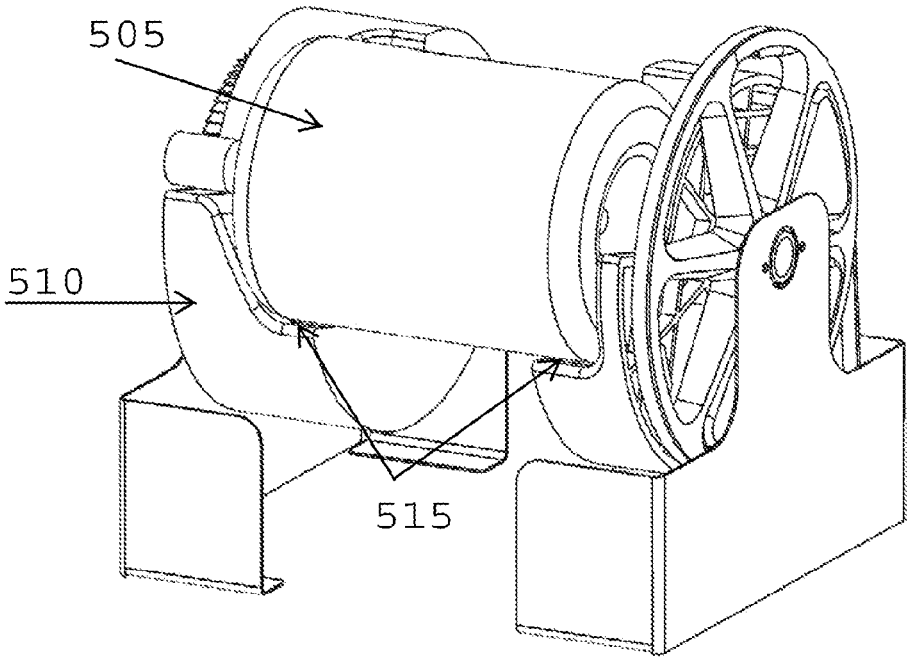
FIG. 5 is a first view of a snail wheel.

FIG. 5 is a first view of a snail wheel. FIG. 5 is an example of the snail wheel 510 where the 5 gallon water bottle 505 has entered the snail wheel 510 and has begun to rotate, approximately 30°. As illustrated in FIG. 5, the snail wheel 510 has flanges 515 that act as support for the 5 gallon water bottle 505. The flanges 515 may be about 1.5-2 inches wide to hold the 5 gallon water bottle 505. The flanges 515 hold and support the 5 gallon water bottle 505 on either end for the highest strength and to avoid damage on impact. The snail wheel 510 may have a spoke pattern on the outside edge. The shape or cam profile of the snail wheel 510, as illustrated in FIG. 5, is designed to slow down the queue of 5 gallon water bottles 505 in the vending machine. The curvature of the snail wheel 510 allows the 5 gallon water bottles 505 to slowly move down the queue as the first 5 gallon water bottle 505 is lifted from the vending machine shelf in the snail wheel 510.

Figure 6:
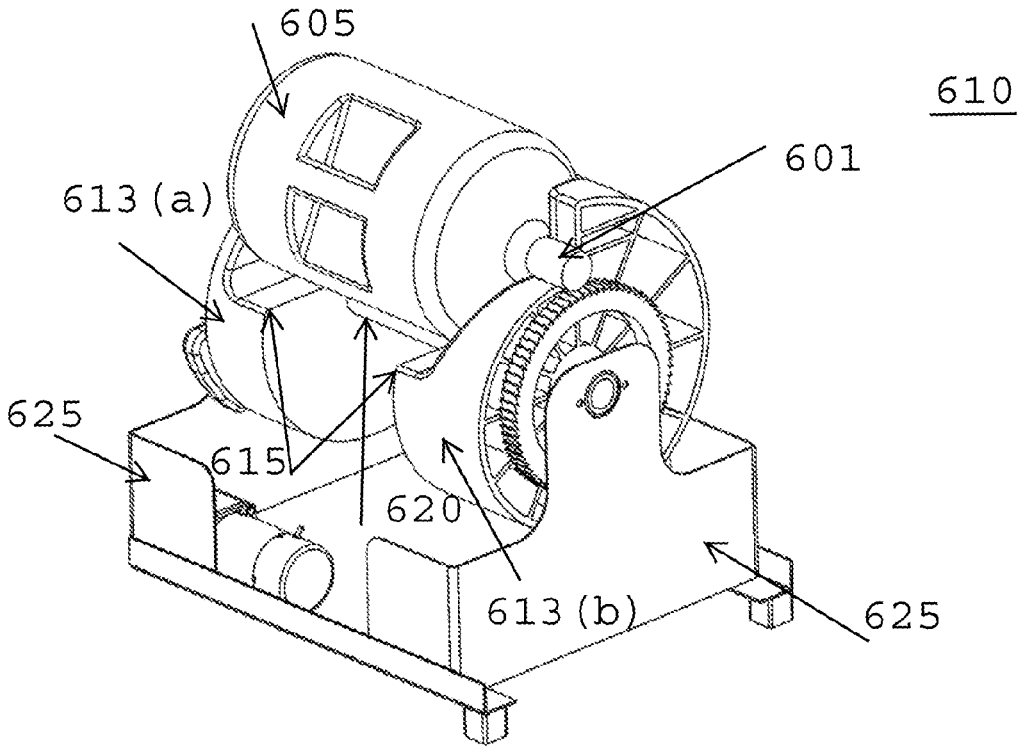
FIG. 6 is a second view of the snail wheel.

FIG. 6 is a second view of the snail wheel. FIG. 6 illustrates the snail wheel 610 which has rotated approximately 90°. In FIG. 6, the 5 gallon water bottle 605 is sitting on the snail wheel 610. The snail wheel 610 includes flanges 615 to cradle the 5 gallon water bottle 605. The neck 601 sits on a lip 612 of the snail wheel 610. The snail wheel 610 has two sides 613(*a*) and 613(*b*). The two sides 613(*a*) and 613(*b*) are plastic and may be created using injection molding, vacuum forming, or the like. The two sides 613(*a*) and 613(*b*) of the snail wheel 610 are connected by a shaft 620 at a center point. The shaft 620 may be 1.5-2 inches in diameter and may be composed of thin walled steel. The shaft 620 is positioned to be in line with a centerline of the 5 gallon water bottle 605. The position of the shaft 620 diminishes the torque on the snail wheel 610 when the 5 gallon water bottle 605 rolls into the snail wheel 610 for delivery to a customer.

The two sides 613(*a*) and 613(*b*) may be connected to shaft 620 with glue. The distance between the two sides 613(*a*) and 613(*b*) may be wide enough to allow part of the bottom shelf of the vending machine to fit between them. This allows the 5 gallon water bottle 605 to remain on the bottom shelf until the snail wheel 610 begins to rotate and lift the 5 gallon water bottle 605 up off the bottom shelf. To secure the shaft 620 in place a bearing 627 is fastened to the end. The bearing 627 is connected to end plate 625.

Figure 7:
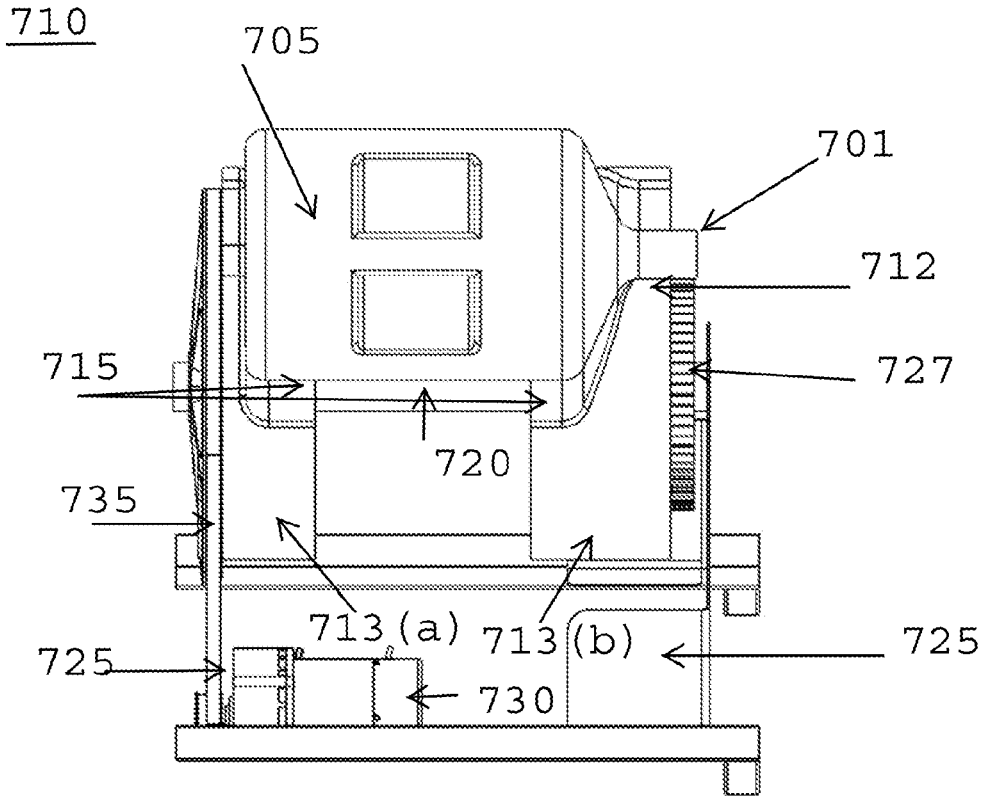
FIG. 7 is a third view of the snail wheel.

FIG. 7 is a third view of the snail wheel. As illustrated in FIG. 7, the 5 gallon water bottle 705 sits on the snail wheel 710. The 5 gallon water bottle 705 is cradled in the snail wheel 710 by the flanges 715. The neck 701 sits on a lip 712 of the snail wheel 710. The two sides 713(*a*) and 713(*b*) are connected with shaft 720. The shaft 720 is secured in place with bearing 727. The bearing 727 is connected to end plate 725. The snail wheel 710 is rotated by a motor 730. In between the side 713(*a*) of the snail wheel 710 and the end plate 725 is a fly wheel with a slip pulley 735, which is described in further detail below. The snail wheel 710 may be powered by a motor 730 attached to the shaft 720. For example, a motor, a crank, or any other mechanism that forces the snail wheel 710 to rotate may be used.

Figure 8:
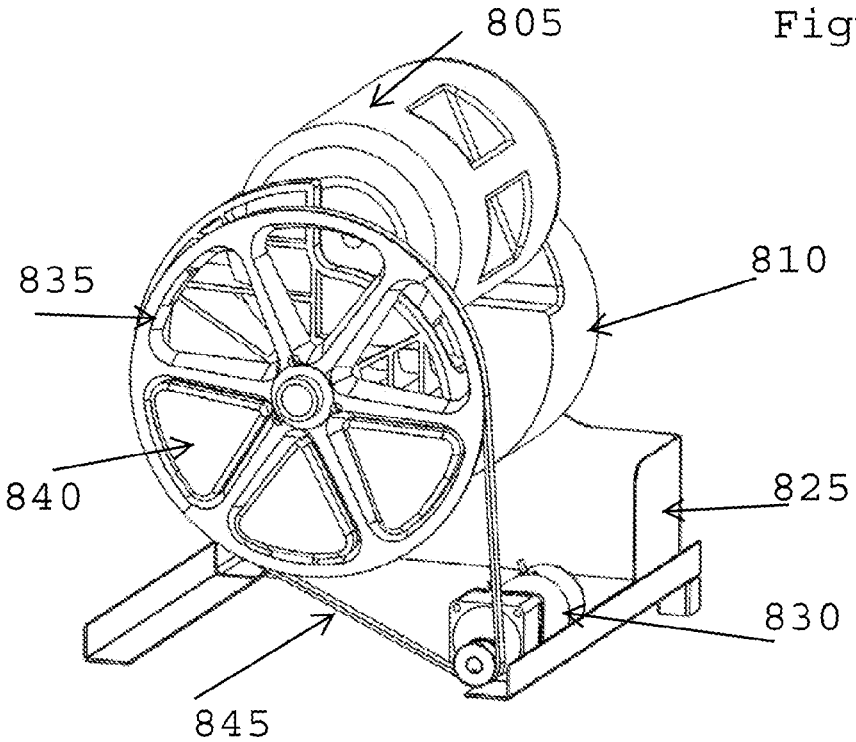
FIG. 8 is a fourth view of the snail wheel with a motor.

FIG. 8 is a fourth view of the snail wheel with a motor. FIG. 8 illustrates the snail wheel 810 of FIG. 7 with on the end plates removed exposing the fly wheel with a slip pulley 835. The fly wheel slip pulley 835 may be made of metal, such as aluminum. The fly wheel slip pulley 835 includes three solid panels 840, which may be made of steel. The solid panels 840 may be included in the fly wheel slip pulley 835 the torque of the snail wheel 810. The fly wheel slip pulley 835 and the solid panels 840 may be die cast. The motor 830 is connected to the fly wheel slip pulley 835 with a belt 845. The belt 845 has enough torque to rotate the snail wheel 810. The motor 830 may have two positions: a first position and a second position. The first position may rotate the wheel 90° counter-clockwise after accepting the 5 gallon water bottle 805. The second position may rotate 270° back to the original position of the snail wheel 805.

Those of ordinary skill in the art may recognize that many modifications and variations of the above may be implemented without departing from the spirit or scope of the following claims. For example, although reference to a 5 gallon water bottle is made, other sizes are possible as well. Thus, it is intended that the following claims cover the modifications and variations provided they come within the scope of the appended claims and their equivalents.

What is claimed:

1. A method for operating a snail wheel in a vending machine, the method comprising:

accepting a 5 gallon water bottle into the snail wheel;

lifting the 5 gallon water bottle up off a bottom shelf of the vending machine;

rotating the snail wheel 90° from a starting point;

stopping the snail wheel after rotating 90°, wherein the 5 gallon water bottle rolls out of the snail wheel and onto a platform; and rotating the snail wheel 270° back to the starting point.

2. The method of claim 1, wherein a customer retrieves the water bottle from the platform.

3. The method of claim 1, wherein the snail wheel is operated with a motor.

4. The method of claim 1, wherein the snail wheel includes two flanges and a lip for the 5 gallon water bottle to rest on.

5. The method of claim 1, wherein the snail wheel includes a first side and a second side.

6. The method of claim 5, wherein the first side and the second side are plastic.

7. The method of claim 1, wherein the snail wheel rotates counter-clockwise.

8. The method of claim 1, wherein a shaft of the snail wheel is aligned with a centerline of the 5 gallon water bottle.

9. The method of claim 1, further comprising:

stopping a second 5 gallon water bottle from entering the snail wheel until a customer requests the second 5 gallon water bottle with a license plate stopper.

10. A snail wheel, comprising:

a first side, wherein the first side includes a flange configured to hold a back end of a 5 gallon water bottle;

a second side, wherein the second side includes a flange configured to hold a front end of the 5 gallon water bottle and a lip configured to hold a neck of the 5 gallon water bottle;

a shaft; and a motor;

wherein the first side and the second side are connected to the shaft at a center point;

wherein the motor is connected to the shaft; and wherein the motor is connected to a fly wheel with a slip pulley.

11. The snail wheel of claim 10, wherein the shaft is connected to the first side and the second side with glue.

12. The snail wheel of claim 10, wherein the first side and the second side are plastic.

13. The snail wheel of claim 10, wherein the shaft is aligned with a centerline of the 5 gallon water bottle.

14. The snail wheel of claim 10, wherein a curvature of the snail wheel slows down a queue of 5 gallon water bottles in a vending machine.

15. A vending machine, comprising;

at least one shelf configured to contain a plurality of 5 gallon water bottles;

an entry point for the plurality of 5 gallon water bottles;

a door to retrieve one of the plurality of 5 gallon water bottles;

a platform behind the door; and a snail wheel configured to move the one of the plurality of 5 gallon water bottles from a bottom position in the vending machine to the platform for retrieval by a customer;

wherein the snail wheel includes a first side including a flange configured to hold a band end of a 5 gallon water bottle;

wherein the snail wheel further includes a second side including a flange configured to hold a front end of the 5 gallon water bottle and a lip configured to hold a neck of the 5 gallon water bottle; and wherein the snail wheel includes a motor that is connected to a fly wheel with a slip pulley.

16. The vending machine of claim 15, wherein the snail wheel is further configured to lift the one of the plurality of 5 gallon water bottles off a bottom shelf in the vending machine and onto the platform.

17. The vending machine of claim 16, wherein the snail wheel rotates 90° counter-clockwise from a starting point to lift the one of the plurality of 5 gallon water bottles off the bottom shelf.

18. The vending machine of claim 17, wherein the snail wheel stops after rotating 90°, wherein the 5 gallon water bottle rolls out of the snail wheel and onto the platform.

* * * * *